United States Patent [19]

Person

[11] 3,939,991

[45] Feb. 24, 1976

[54] PARKING BRAKE FOR SUBSEA MINING LIFT SYSTEM

[75] Inventor: Abraham Person, Los Alamitos, Calif.

[73] Assignee: Global Marine, Inc., Los Angeles, Calif.

[22] Filed: June 13, 1974

[21] Appl. No.: 478,932

[52] U.S. Cl. ..... 214/1 P; 114/.5 D; 214/2.5; 294/90

[51] Int. Cl.[2] ..... E21B 19/14

[58] Field of Search ..... 214/1 P, 2.5; 114/.5 D; 175/5–10, 85; 166/.5, 98; 294/90

[56] References Cited

UNITED STATES PATENTS

| | | | |
|---|---|---|---|
| 3,145,786 | 8/1964 | O'Neill et al. | 214/2.5 X |
| 3,177,944 | 4/1965 | Knights | 214/2.5 X |

FOREIGN PATENTS OR APPLICATIONS

| | | | |
|---|---|---|---|
| 907,824 | 10/1962 | United Kingdom | 175/85 |
| 1,110,562 | 4/1968 | United Kingdom | 175/85 |

*Primary Examiner*—Frank E. Werner
*Attorney, Agent, or Firm*—Christie, Parker & Hale

[57] ABSTRACT

A parking brake for subsea mining equipment that is raised and lowered by a pipe string from a surface vessel. The brake assembly is mounted between a pair of linear lift units that alternately grip equally spaced collars on the pipe and move the pipe string in incremental steps. The brake includes a releasable yoke for engaging one of the collars. The yoke is rotatable to permit rotation of the pipe string by the brake assembly. The position of the brake is such that either drive unit may be used to position the pipe string so that a collar is engaged by the yoke of the brake assembly.

6 Claims, 4 Drawing Figures

PARKING BRAKE FOR SUBSEA MINING LIFT SYSTEM

FIELD OF THE INVENTION

This invention relates to apparatus for raising and lowering a segmented pipe string from a surface vessel to the ocean floor, and more particularly is concerned with a parking brake assembly for locking the pipe string against movement relative to the ship.

BACKGROUND OF THE INVENTION

In copending application Ser. No. 479,094, filed June 13, 1974, entitled "Hydraulically Operated Heavy Lift System for Vertically Moving a String of Pipe" and assigned to the same assignee as the present invention, there is described a lift system for raising and lowering a segmented string of pipe from the deck of a surface vessel. In the heavy lift system therein described, two linear lift units are spaced along the axis of the pipe string and are arranged to alternately engage spaced collars on the pipe and move the pipe string vertically in incremental steps. Each lift unit has a stroke equal to approximately half the distance between collars. One or the other of the lift units supports the entire load of the pipe string and associated subsea mining equipment attached to the end of the pipe string. Either lift unit therefore may be subject to loads of 9,000 or 10,000 tons. It is desirable therefore to provide some means to "park" the system so as to remove the load from the lift units during static hold conditions, as a safety backup in the event of operating failure of either the heavy lift units, and to make emergency repairs on the lift system. The parking brake must be integrated with the heavy lift units so that it can function to transfer the load from the heavy lift units to the parking brake in the event of any one of a number of failure conditions which might occur in the heavy lift system, such as when either one of the drive units won't move, or a load supporting element of either drive unit won't engage or won't release. It is also necessary in controlling the load supported by the pipe to be able to rotate the pipe to align the load in particular angular direction.

SUMMARY OF THE INVENTION

The present invention is directed to a parking brake assembly for use in combination with a heavy lift system of the type described in the above-identified copending application which is capable of supporting and rotating a load-supporting string of pipe extending between a surface vessel and deep ocean mining equipment. The parking brake is positioned along the pipe string such that either lift unit can move the pipe string sufficiently to bring one of a series of spaced collars on the pipe into engagement with the parking brake mechanism.

BRIEF DESCRIPTION OF THE DRAWINGS

For a more complete understanding of the invention, reference should be made to the accompanying drawings, wherein.

DETAILED DESCRIPTION

Figure 1:
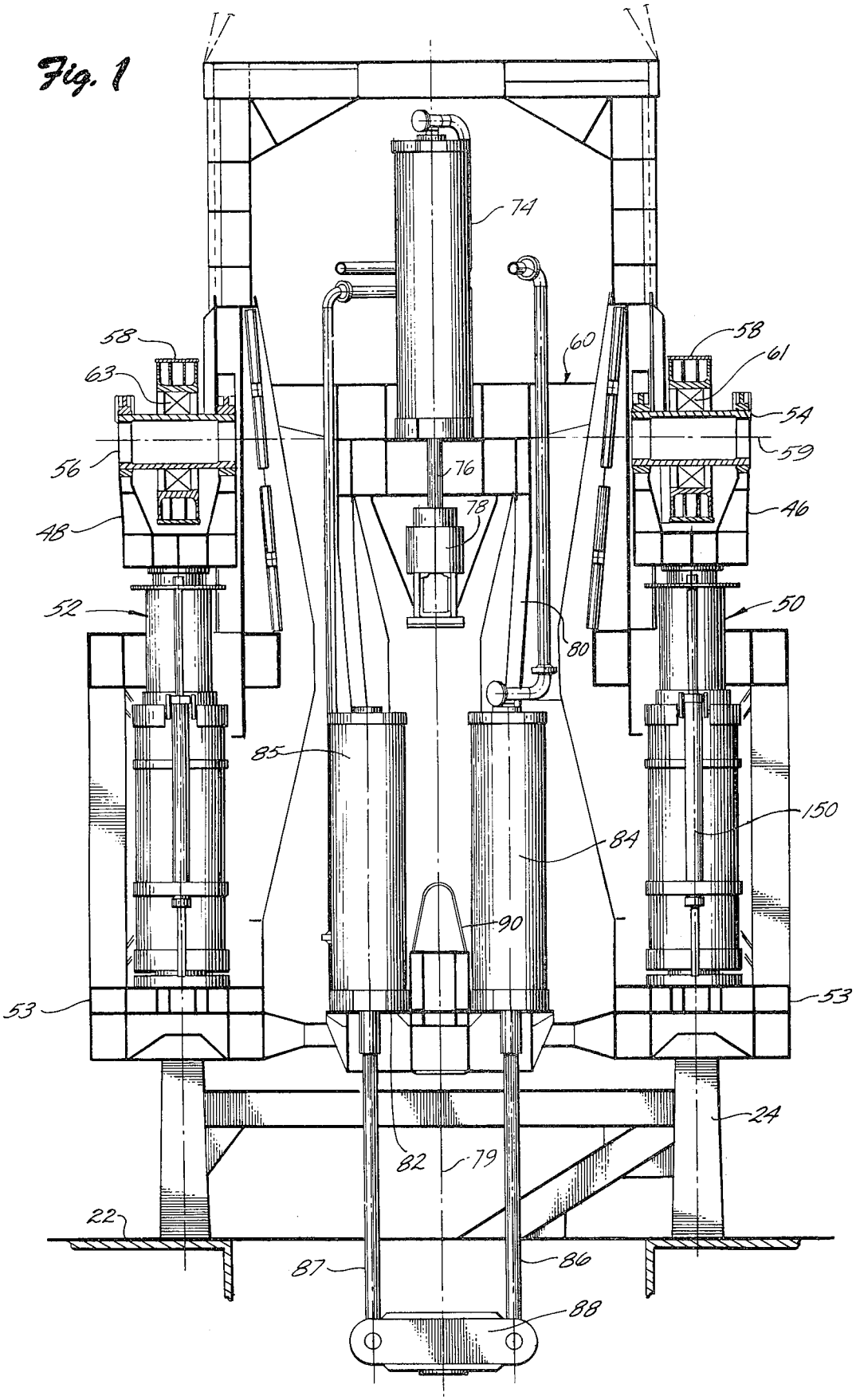
FIG. 1 is a cross-sectional view of the heavy lift system and associated parking brake assembly.

Referring to FIG. 1 in detail, there is shown a portion of the gimbal-mounted heavy lift system described in detail in the above-identified copending application. The heavy lift system is supported over the docking well from the deck 22 and A-frame assembly 24 by means of a heave compensated supporting structure including hydraulic rams 50 and 52. On top of the rams 50 and 52 are supported the bearing structure, including guide frames 46 and 48, stub shafts 54 and 56, and bearings 61 and 63, for an outer gimbal frame 58 which pivots about an axis 59. An inner gimbal frame, indicated generally at 60, is in turn pivotally supported about an axis perpendicular to the axis 59 within the outer gimbal frame 58. The inner gimbal frame 60 includes a cage structure indicated generally at 80 which extends downwardly and terminates in a lower platform 82.

A pair of upper hydralic cylinders, one of which is indicated at 74, are mounted at the top of the inner gimbal frame 60 one behind the other, as viewed in FIG. 1. The cylinders 74 operate lift rods 76. The lower ends of the rods 76 are joined by an upper yoke assembly 78 which bridges the space between the cylinders. The yoke assembly includes means for releasably supporting a string of pipe extending vertically between the cylinders 74 along the axis 79.

A lower pair of cylinders 84 and 85 are mounted on top of the lower platform 82 and actuate respectively lift rods 86 and 87. The rods are joined at their lower end by a pipe supporting lower yoke 88. The parking brake assembly, indicated generally at 90, is also mounted on the platform 82 along the vertical lift axis 79 of the heavy lift system. The parking brake, as hereinafter described in detail, engages the pipe string to transfer the full load of the mining equipment directly to the gimbal structure and off the heavy lift cylinders. The parking brake also operates to rotate the pipe string and associated mining equipment.

As described in detail in the above-identified copending application, the upper cylinders 74 and lower cylinders 84 and 85 are hydraulically controlled so as to move reciprocally up and down along the vertical axis of the pipe string, the upper and lower cylinders operating substantially out of phase so that one set of cylinders is raising the associated yoke, while the other set of cylinders is lowering the other yoke. By controlling the upper yoke 78 and lower yoke 88 to alternately engage and disengage the pipe string, the hydraulic cylinders operate to continuously move the pipe string vertically in incremental steps, so as to either raise or lower the associated mining equipment.

Figure 2:
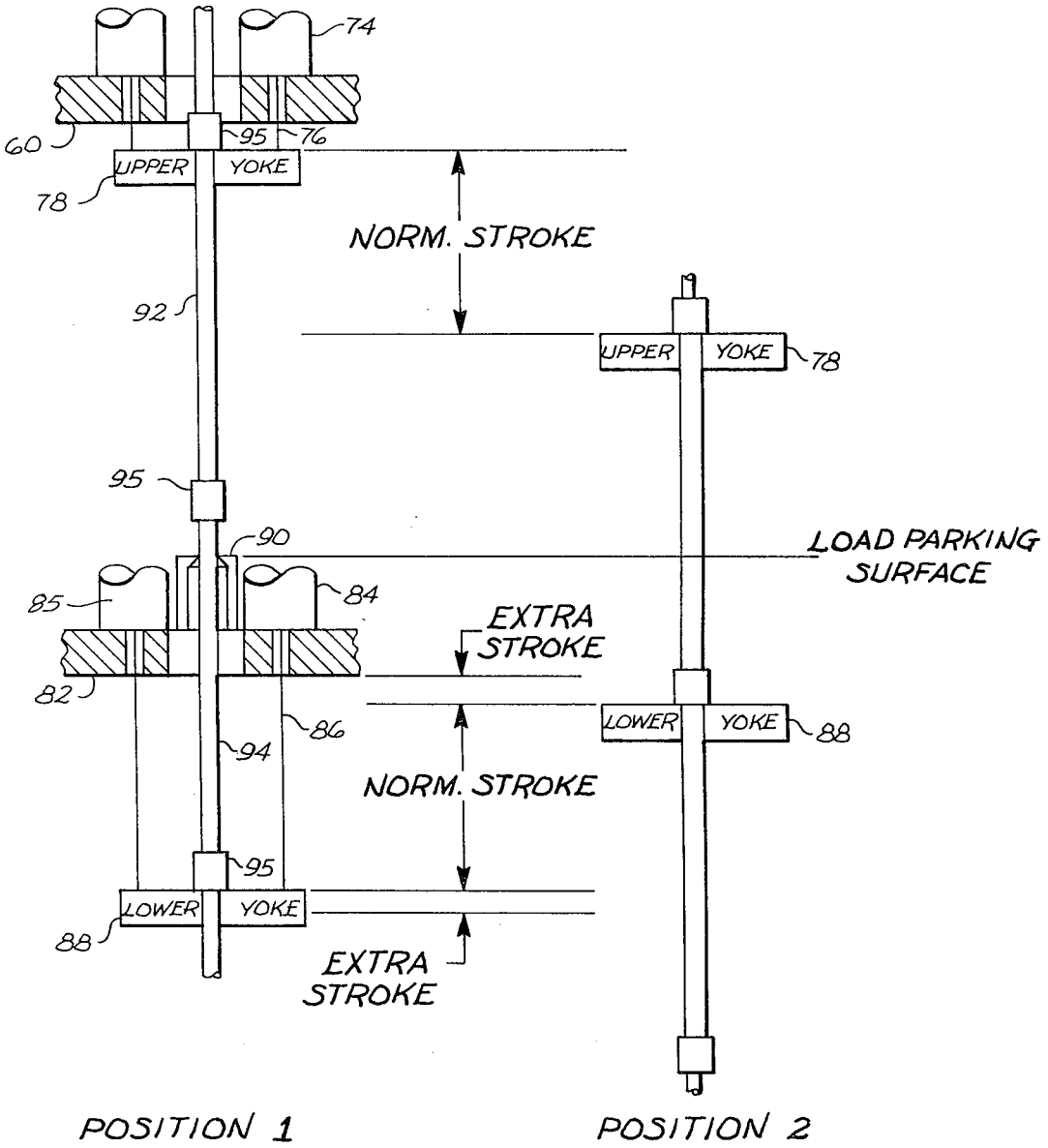
FIG. 2 is a schematic showing of the positioning of the pipe string by the heavy lift system in transferring the load to the parking brake.

Referring to the schematic drawing of FIG. 2, the operation of the heavy lift system in combination with the parking brake can be better understood. Position 1 shows the upper yoke 78 at the top of its normal stroke, while the lower yoke 88 is at the bottom of its normal stroke. In this position the upper yoke and lower yoke are separated by a distance corresponding to two pipe sections, indicated generally at 92 and 94. Each pipe section is terminated at its upper end in a collar 95 which can be engaged or released by the upper and lower yokes, so as to transfer the load alternately between the upper and lower cylinders.

Position 2 of FIG. 2 shows the upper yoke 78 at the bottom of its normal stroke with the lower yoke 88 at the top of its normal stroke. The pipe string, in this position, is shifted half the distance between adjacent collars from position 1, the upper and lower yokes being separated by the length of one pipe section. By this arrangement, the upper and lower cylinders and associated yokes are controlled to alternately move the pipe string in incremental steps corresponding to half the length of a pipe section.

The parking brake assembly 90 is positioned slightly below the mid-point between the bottom position of the upper yoke 78 and the upper position of the lower yoke 88. In this position, the intermediate collar 95 in position 1 can be lowered to engage the top of the parking brake assembly 90 by the extension of the cylinders 74. The lower cylinders 84 are provided with an extra stroke range below the bottom of the normal stroke range which permits the middle pipe collar 95, when in position 1, to be lowered by the lower cylinders 84 and 85 onto the parking brake assembly 90. With the pipe string in position 2 of FIG. 2, the collar engaged with the upper yoke 78 can be released and lowered by the lower cylinders 84 and 85 onto the parking brake, or the pipe string can be raised by the upper cylinders 74 so as to bring the collar engaged with the lower yoke 88 up to the level of the parking brake assembly 90. Thus, regardless of the relative position of the upper and lower yokes, either the upper cylinders 74 or lower cylinders 84 and 85 can be used to position a collar on the pipe string onto the parking brake assembly 90. The same is also true if either yoke at any point in time fails to function either to open or to close.

Figure 3:
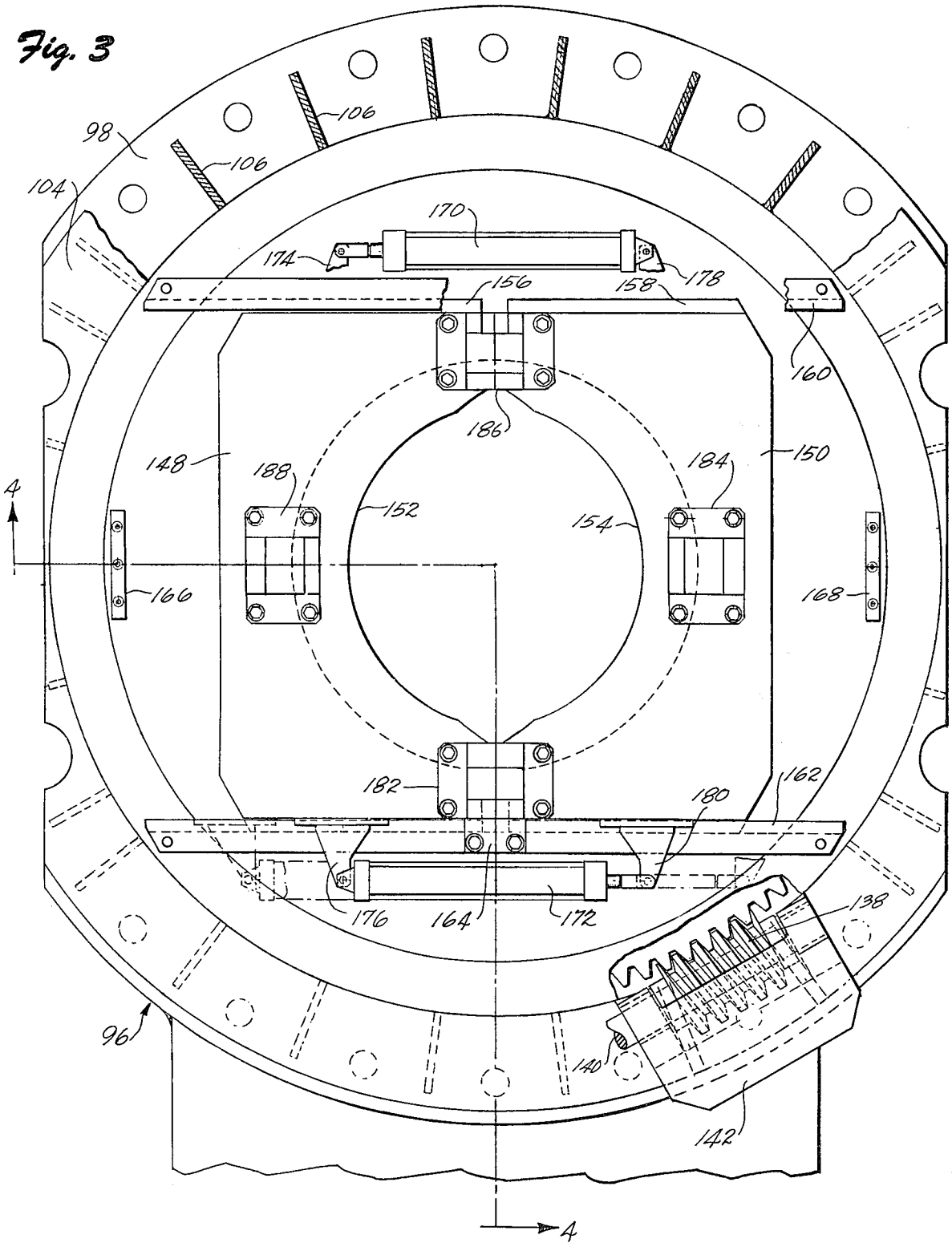
FIG. 3 is a top view of the parking brake assembly.
Figure 4:
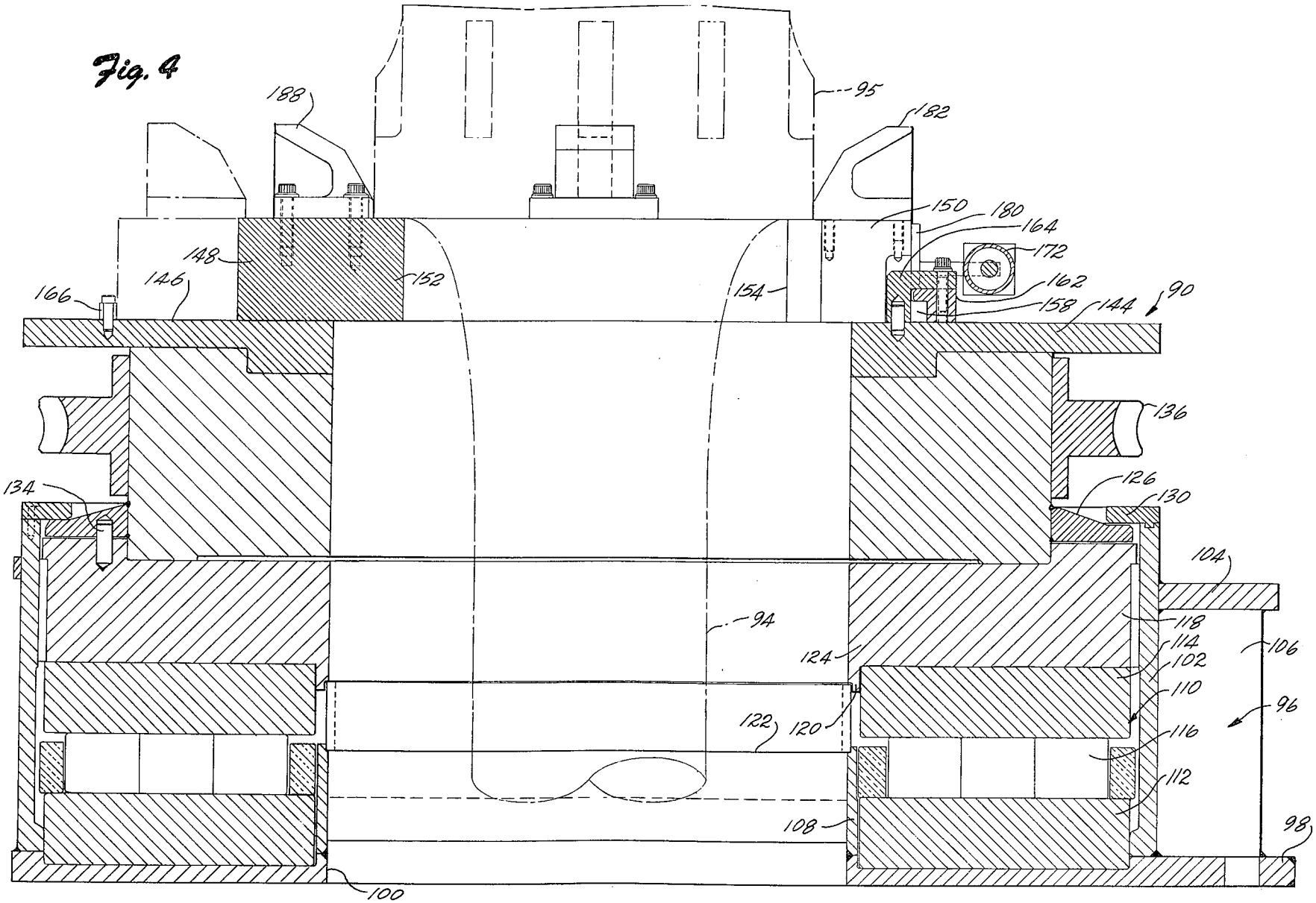
FIG. 4 is a sectional view taken substantially on the line 4—4 of FIG. 3.

Referring to FIGS. 3 and 4, the parking brake assembly 90 is shown in detail. The parking brake assembly 90 includes a base frame indicated generally at 96, which includes a base plate 98 having a central opening 100 through which the pipe string is adapted to pass. The opening 100 is greater in diameter than the collars 95 of the pipe string. The base plate 98 is adapted to be bolted or otherwise secured on the platform 82 between the cylinders 84 and 85. Welded to the base plate 98 is a cylindrical sidewall 102. An upper flange 104 extends around the outside of the cylindrical sidewall 102 and is joined to the base plate 98 by a plurality of angularly spaced reinforcing ribs 106. The base frame 96 in addition includes an inner cylindrical flange 108 projecting upwardly around the opening 100 in the base plate 98.

Seated in the annular space between the inner flange 108 and the sidewall 102 is a heavy duty thrust bearing indicated generally at 110. The thrust bearing includes a lower race 112 seated on the base plate 98, an upper race 114, and a plurality of rollers 116 which permit the upper race 114 to rotate relative to the lower race 112.

Supported on the thrust bearing 110 is a support ring 118 having a lower annular lip 120. A bearing shield 122 extends between the inner flange 108 of the base plate 98 and the annular lip 120 of the support ring 118. A load ring assembly is mounted on top of the support ring 118, the assembly including a load ring 124 which rests on top of the support ring 118. A radial flange 126 extends around the outer periphery of the load ring 124, the radial flange projecting under a retaining ring 130 which is screwed to the top edge of the sidewall 102. The retaining ring 130 consists of at least two sections so that it can be easily removed during assembly and disassembly of a parking brake. A plurality of dowel pins 134 lock the load ring assembly to the support ring 118.

Also secured to the outer periphery of the load ring 124 is a worm wheel 136. As best seen in FIG. 3, a worm gear 138 engages the worm wheel 136. The worm gear 138 is mounted on a drive shaft 140, the shaft being journaled at either end of the worm gear 138 in a bearing block 142. The bearing block 142 is anchored on the flange 104 on the support assembly 96. The shaft 40 is driven by a suitable electric motor drive (not shown) for applying rotation to the load ring assembly.

The load ring assembly further includes a clamp support plate 144 which is bolted or otherwise secured to the top of the load ring 124. The clamp support plate 144 has a smooth finished flat top surface 146 on which is slidably supported a pair of movable clamping members 148 and 150. The clamping members have arcuate inner surfaces 152 and 154 respectively which are of smaller radius than the outside of the pipe collar 94 so that when the clamping members are in the closed position, the pipe collar 95 engages the top of the clamp members, as shown in FIG. 4.

The clamping members 148 and 150 are movable away from each other from the closed position shown in the drawings to an open position in which the pipe collar is released. The clamp members are provided with linear guide flanges 156 and 158, respectively, extending along opposite ends of the clamping members and engaging a pair of guide tracks 160 and 162 mounted on the top surface 146 of the clamp support plate 144. A stop member 164 is positioned at the center of the guides 160 and 162 to limit the inward movement of the clamp members 148 and 150 so as to center the clamp members when in the closed position. Outer stops 166 and 168 are bolted to the surface 146 to limit the outward movement of the clamp members 148 and 150 in the open position.

Movement of the clamping members 148 and 150 between the closed and open positions is effected by a pair of hydraulic linear actuators 170 and 172. The actuators are connected at one end by brackets 174 and 176 to the clamping member 148. The other end of the actuators are connected by brackets 178 and 180 to the clamping member 150. To help center the collar of the pipe string, four pipe collar centering guides 182, 184, 186, and 188 are provided. The guides are bolted or otherwise secured to the top of the clamping members 148 and 150. The centering guides 182 and 186 are divided into two parts so as to permit the respective clamping members 148 and 150 to move apart. As best seen in FIG. 4, the centering guides are provided with inwardly sloping surfaces which engage the collar and, by wedging action, force the collar into a centered position on the parking brake.

From the above description it will be recognized that an improved parking brake arrangement is provided for locking a vertically moving pipe string in position. The parking brake is capable of clamping and supporting or releasing substantial loads while at the same time permitting a load to be rotated through 360°.

What is claimed is:

1. Apparatus for raising and lowering a string of pipe having collars at intervals along the pipe, comprising first supporting means positioned along the pipe for releasably supporting a collar, first linear drive means for moving said first supporting means reciprocally lengthwise of the pipe, second supporting means positioned along the pipe for releasably supporting a collar, second linear drive means for moving said second supporting means reciprocally lengthwise of the pipe, and third supporting means positioned along the pipe for releasably supporting a collar, means retaining the third supporting means in fixed position along the path of movement of the pipe string in between the limits of movement of the first and second supporting means, either drive means moving the pipe string sufficiently to position a collar at the third supporting means.

2. Apparatus of claim 1 wherein the third supporting means includes means for rotating said third supporting means about the longitudinal axis of the pipe to rotate the pipe.

3. Apparatus of claim 1 wherein the third supporting means includes a plate having a central opening through which the pipe string and collars are driven, and a pair of clamping members slidably supported on the plate on either side of the opening for movement toward and away from each other, the clamp members having opposed recesses forming an opening between the clamp members when the members are in abutting position, the opening being smaller than the outside of the collars but larger than the pipe whereby the pipe can move through the opening but a collar cannot, and means for moving the clamping members toward and away from each other.

4. Apparatus of claim 3 wherein the third supporting means further includes a base member, the plate being rotatably supported on the base member for rotation about the axis of the pipe string, and drive means mounted on the base for applying torque to the plate to rotate the plate and associated clamping members.

5. In a lift system for raising and lowering a string of pipe having collars at equally spaced intervals, the combination of first drive means releasably engageable with one of said collars, the first drive means when engaged with the pipe moving the pipe linearly half the distance between two adjacent collars, second drive means releasably engageable with one of said collars, the second drive means when engaged with the pipe moving the pipe linearly half the distance between two adjacent collars, supporting means releasably engageable with one of said collars for supporting the string of pipe in a fixed vertical position, and means securing the first and second drive means and the supporting means in spaced apart relationship along the path of the pipe string with the supporting means between the first and second drive means, the supporting means being positioned to engage a collar at a point where either drive means can move the pipe string to position a collar at the support means.

6. Apparatus of claim 5 wherein the support means includes means for rotating the pipe string when the support means is engaged with a collar on the pipe string.

* * * * *